US008833226B2

(12) United States Patent
Buhl

(10) Patent No.: US 8,833,226 B2
(45) Date of Patent: Sep. 16, 2014

(54) SELECTIVE BREECHBLOCK AND/OR AMMUNITION DRIVE

(75) Inventor: Rainer Buhl, Dornhan-Weiden (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 13/486,618

(22) Filed: Jun. 1, 2012

(65) Prior Publication Data

US 2012/0318126 A1 Dec. 20, 2012

Related U.S. Application Data

(63) Continuation of application No. PCT/EP2010/007076, filed on Nov. 23, 2010.

(51) Int. Cl.
*F41A 9/50* (2006.01)
*F41A 7/08* (2006.01)

(52) U.S. Cl.
CPC .... *F41A 7/08* (2013.01); *F41A 9/50* (2013.01)
USPC ..... 89/9; 89/33.01

(58) Field of Classification Search
USPC ..... 89/33.01, 9, 33.2, 33.25
See application file for complete search history.

(56) References Cited

U.S. PATENT DOCUMENTS

| | | | |
|---|---|---|---|
| 4,301,709 | A | 11/1981 | Bohorquez et al. |
| 4,418,607 | A | 12/1983 | Price |
| 4,481,858 | A | 11/1984 | Price |
| 4,563,936 | A | 1/1986 | Cleary et al. |
| 4,665,793 | A | 5/1987 | Cleary et al. |

FOREIGN PATENT DOCUMENTS

| | | | |
|---|---|---|---|
| DE | 30 21 179 | A1 | 12/1980 |
| DE | 30 21 200 | | 12/1980 |
| DE | 10 2007 048 468 | | 4/2009 |
| DE | 10 2007 054 470 | A | 5/2009 |
| JP | 6 159991 | A | 6/1994 |
| JP | 7 174488 | A | 7/1995 |

*Primary Examiner* — Daniel J Troy
(74) *Attorney, Agent, or Firm* — Muncy, Geissler, Olds & Lowe, P.C.

(57) ABSTRACT

A combined breech and ammunition drive is provided for a breech of a weapon and/or for introducing ammunition by a feeding star using an external drive, wherein the respective drive is selectively engaged and disengaged. A selector drum that interacts with the drives has slots for the selective engagement and disengagement, and elements are guided in the slots, the slot moving component which engage into the drives in a form-fitted and force-closed manner and which can thereby engage and disengage same. The component being 3-way jaw clutches for example.

16 Claims, 4 Drawing Sheets

SELECTIVE BREECHBLOCK AND/OR AMMUNITION DRIVE

This nonprovisional application is a continuation of International Application No. PCT/EP2010/007076, which was filed on Nov. 23, 2010, and which claims priority to German Patent Application No. DE 10 2009 056 736.4, which was filed in Germany on Dec. 4, 2009, and which are both herein incorporated by reference.

BACKGROUND OF THE INVENTION

1. Field of the Invention

The invention relates to a selectively switchable breechblock and/or ammunition drive for feeding of a round of ammunition/cartridge into a chamber of a gun barrel, with which in certain cases the feeding of the breechblock and/or of a round of ammunition in front of the breechblock can be suppressed with the weapon drive continuing to run. Such an option must be provided, inter alia, for the cases in which no breechblock motion must be allowed to take place, for example when the weapon is to be reloaded or a round of ammunition that is located further back in the ammunition magazine or belt element is to be selected.

2. Description of the Background Art

It is well known for a cartridge to be placed in front of a breechblock and for the cartridge to be brought into the gun barrel with the aid of the breechblock motion. The breechblock motion here is based on dwell times during which the breechblock cannot be allowed to move.

The externally driven autocannon known under the name Bushmaster has a circulating chain as the function control and drive for moving the breechblock and ammunition feed, which also gives it the name "chain gun." Required dwell times are implemented by the guidance of the chain (U.S. Pat. No. 4,418,607; U.S. Pat. No. 4,481,858; U.S. Pat. No. 4,563,936; U.S. Pat. No. 4,665,793; DE 30 21 200 C, which corresponds to U.S. Pat. No. 4,301,709).

DE 10 2007 048 468 A describes a drive for linear feeding of ammunition to a gun barrel or chamber by means of a chain. The chain itself is guided closely around two sprockets in a simple manner. A chain link or a cam of the chain is engaged in a guide or channel located below the movable slider. By this means, the chain can continue to move during dwell periods of the weapon that are defined by the function control. The chain itself can be driven by an electric motor.

In contrast, for linear feeding of a breechblock to the gun barrel or chamber, DE 10 2007 054 470 A proposes incorporating a straight guide channel into the drive kinematics. A component that is structurally connected to the breechblock is guided in the guide channel. The guide channel in turn is surrounded by a circulating guide (gate), which in its turn interprets the required dwell times of the breechblock during locking, firing, and unlocking in its forward position, and during reloading after the breechblock has been guided to its rear position. An additional component is guided in the guide as the drive means for the breechblock. The transmission of the drive can be implemented by means of rollers, gears, or the like, which are driven by a motor, etc. The drive itself continues to run during the dwell periods of the weapon.

In special cases, it must be possible to remove the breechblock drive and/or the ammunition drive from the system.

SUMMARY OF THE INVENTION

It is therefore an object of the invention has the object of disclosing a design for selectively switching on and off the applicable drive from the weapon system.

In order for the weapon's construction to be smaller, rear-locking of the breechblock is provided in an embodiment, since in this way the feed travel of the round of ammunition can be made shorter. This eliminates the construction space otherwise required for front locking, which the round of ammunition would have to traverse before reaching the chamber. However, other breech designs are also possible; the selective switching on and off of the drives is not dependent on the locking type itself.

Breechblock guidance with the required dwell times is produced by means of slots between which a (control) slider is engaged, said slider in turn being functionally connected to the breechblock support or directly to the breechblock. This involves what is known as a slot fixed with respect to the weapon for the breechblock feeding and a locking slot for locking the breechblock. The slot fixed with respect to the weapon for the breechblock feeding, which preferably is integrated below the breechblock, works together with a first, longer connecting rod of a cam disk of the breechblock drive.

By means of the longer connecting rod, the breechblock support, and thus the breechblock, are moved in the firing direction and opposite thereto. The rotary motion of the cam disk is converted into a linear motion here. To this end, the connecting rod is fastened to/integrated into the slot at its back end or pin. The connecting rod engages at its front end (viewed in the direction of firing) via toothing with the rack fixed with respect to the weapon and the slider of the breechblock support. In this design, a better transmission ratio for the breechblock motion can be established. An additional, shorter connecting rod is incorporated into the slider; this connecting rod engages the slider, and also has means by which a functional connection is produced between the slot fixed with respect to the weapon and the breechblock support or the breechblock. In a preferred embodiment, this involves two rollers, wherein the lower roller engages the slot fixed with respect to the weapon and the upper roller engages a transverse channel in the breechblock support.

The zero position (breechblock dwell) is integrated into the rear endpoint of the slot fixed with respect to the weapon; the dwell time of the breechblock during the firing position is defined in the locking slot, which is integrated circumferentially into the breechblock support.

For feeding the round of ammunition in front of the breechblock, which is to say while the latter has assumed its zero position, the ammunition feed is moved by the common drive. An index drive with cam follower wheel that works together with this slot then transfers this motion to a feeding star by which the round of ammunition is placed in front of the breechblock in a known manner. The feeding star in turn executes a motion and brings a new round of ammunition in front of the breechblock, brings the empty cartridge casing into the belt element, etc. This process is cycled by the index drive.

For normal firing, the breechblock drive and also the ammunition drive are switched on in the system.

Based on the fact that the guidance of the breechblock and the feeding of the round of ammunition in front of the breechblock is implemented, in particular, by a common mechanism (construction), provision is henceforth made that, for special cases, the applicable drive that is not required can be selectively switched off or disconnected in the mechanism. The common drive includes two synchronizable (cam) disks or gears provided with external toothing, for example.

For the selective (optional) switching off or on of the applicable drive, a separately drivable selector drum is incorporated, which in turn can bring means into or out of engagement with the applicable drive. This means can be an upper and lower square jaw clutch. The selector drum has cams on its circumference in which are guided elements through which the means can engage or release the drives in an interlocking and force-guided manner, making it possible to switch the applicable drive on or off.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
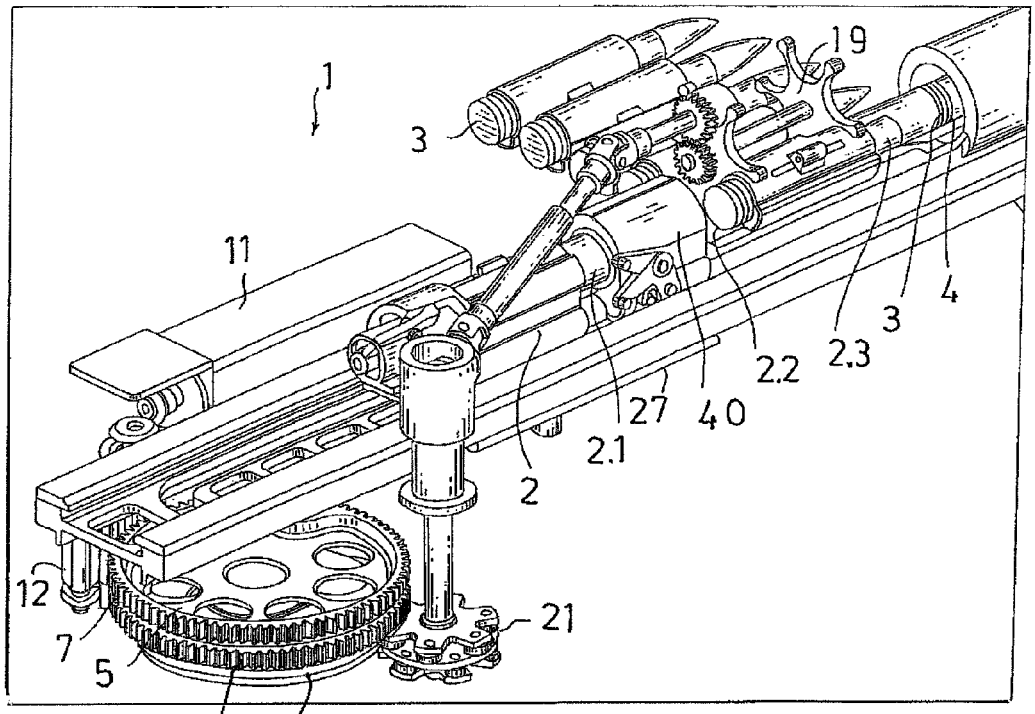
FIG. 1 is a perspective view of a weapon, partially without housing, with a selective breechblock and ammunition drive.

In the figures, 1 identifies a weapon that is characterized by straight feeding of a breechblock 2.1 or breechblock support 2 to feed a round of ammunition 3 into a chamber 4 of a weapon barrel of the weapon 1. For a version with a more compact construction, rear locking of the breechblock 2.1 is provided. The end face of the breechblock 2.1 is made such that it can engage in the groove in the cartridge base of the cartridge or round of ammunition 3, and can carry it forward into the chamber 4 and can carry it out of the chamber 4 again after firing and deposit it in a feeding star. Obturation to the chamber 4 of the gun barrel 1 itself is accomplished by means of the casing of the round of ammunition 3.

The firing pin (not shown in detail) required for ignition of the round of ammunition 3 is guided and held inside the breechblock chamber 2.3. The number 5 identifies a drive for the breechblock drive and 6 identifies the drive for feeding the round of ammunition 3. In both cases, these drives are disks that have external toothing 7, 8.

A gear with toothing 9 or 10, which is driven by an external drive 11, for example, engages in each of these sets of external toothing 7, 8. The gears 9, 10, in turn, are carried by a shaft 22 that is driven by the external drive 11.

The feeding of the breechblock 2.1 or breechblock support 2 is accomplished by means of gates and guides, integrated into the weapon system, for the feed and dwell times.

Figure 2:
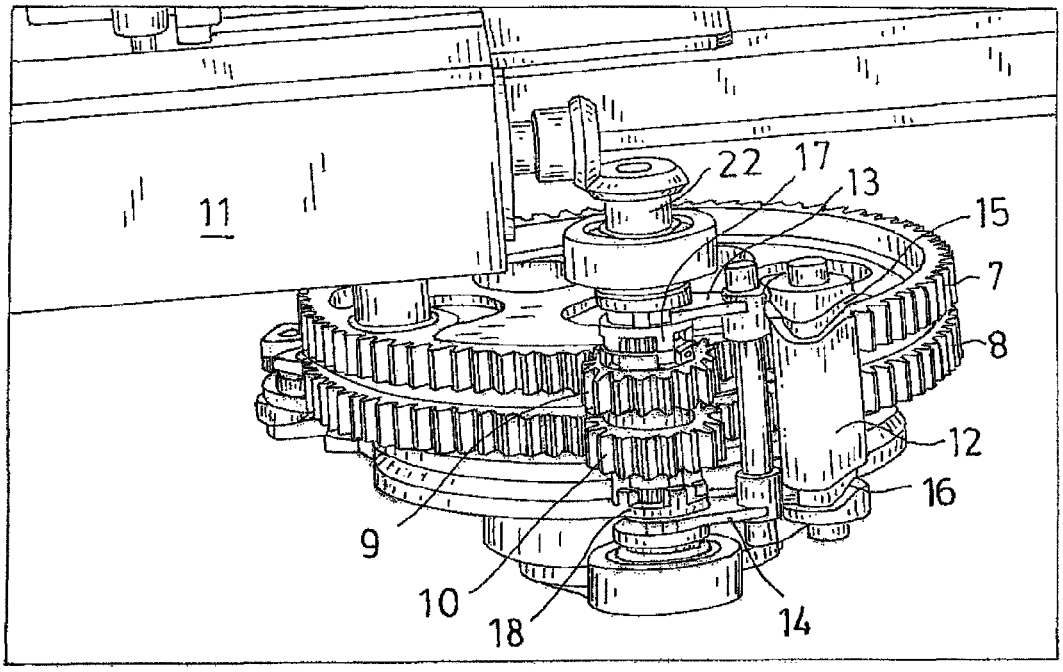
FIG. 2 is a view of the selective drive from FIG. 1.

Components 17, 18, which can engage the gears 9 or 10 (or neither of the two) in an interlocking and force-locking manner serve to selectively switch off or on the breechblock drive and the ammunition drive 5, 6. A separately drivable selector drum 12, by means of which the drives 5, 6 can be selectively switched on, is responsible for this engagement or disengagement (see FIG. 2). To this end, the selector drum 12 has cams 15, 16 which guide control sleeves 13, 14, and the control sleeves 13, 14, in turn move the components 17, 18, which components, in this embodiment, comprise jaw clutches.

Figure 3:
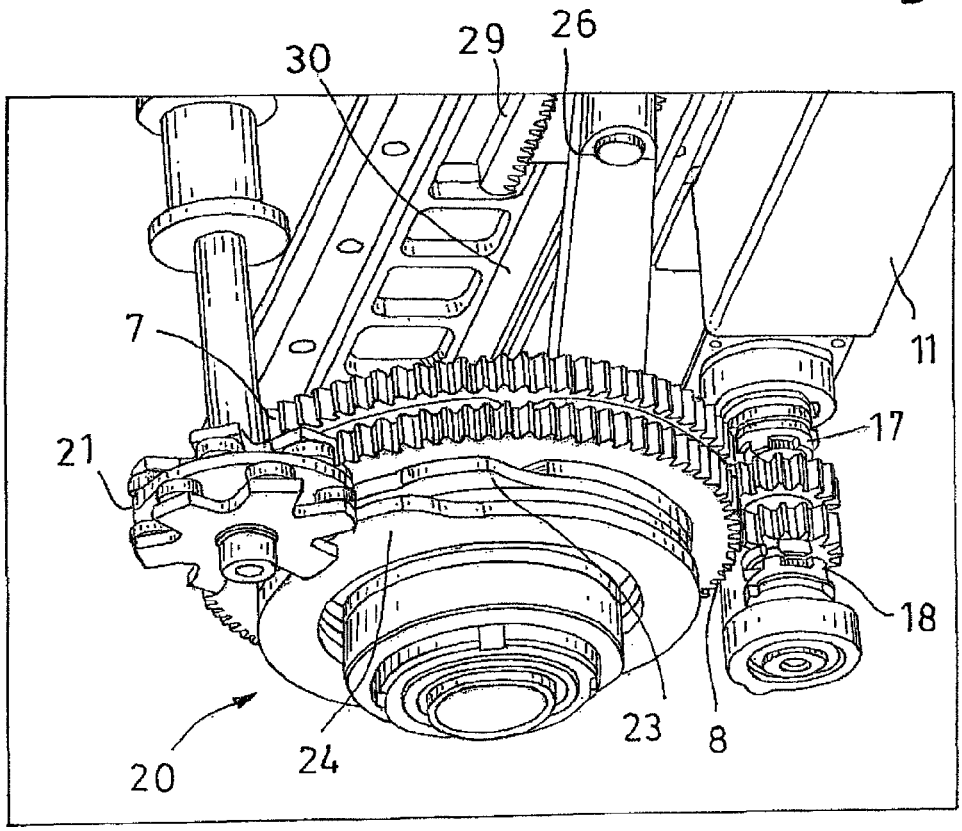
FIG. 3 is the drive from FIG. 2 in a perspective view from below.

FIG. 3 shows a perspective view of the drive 5, 6 from below. Incorporated beneath the drive 6 for the ammunition feed is an index drive 20, here a disk index drive, with a complementary disk pair having detent and operating angles and a cam follower wheel 21. The cam follower wheel 21 is set in motion by the cams of the disk pair and is functionally matched to the drive shaft of the ammunition feed to the feeding star 19. The operating angle is determined by the part of the cam that accomplishes the rotation of the cam follower wheel 21 by one step; the detent angle is determined by the part of the cam in which the cam follower wheel 21 does not change its position despite rotation of the cam.

Figure 4:
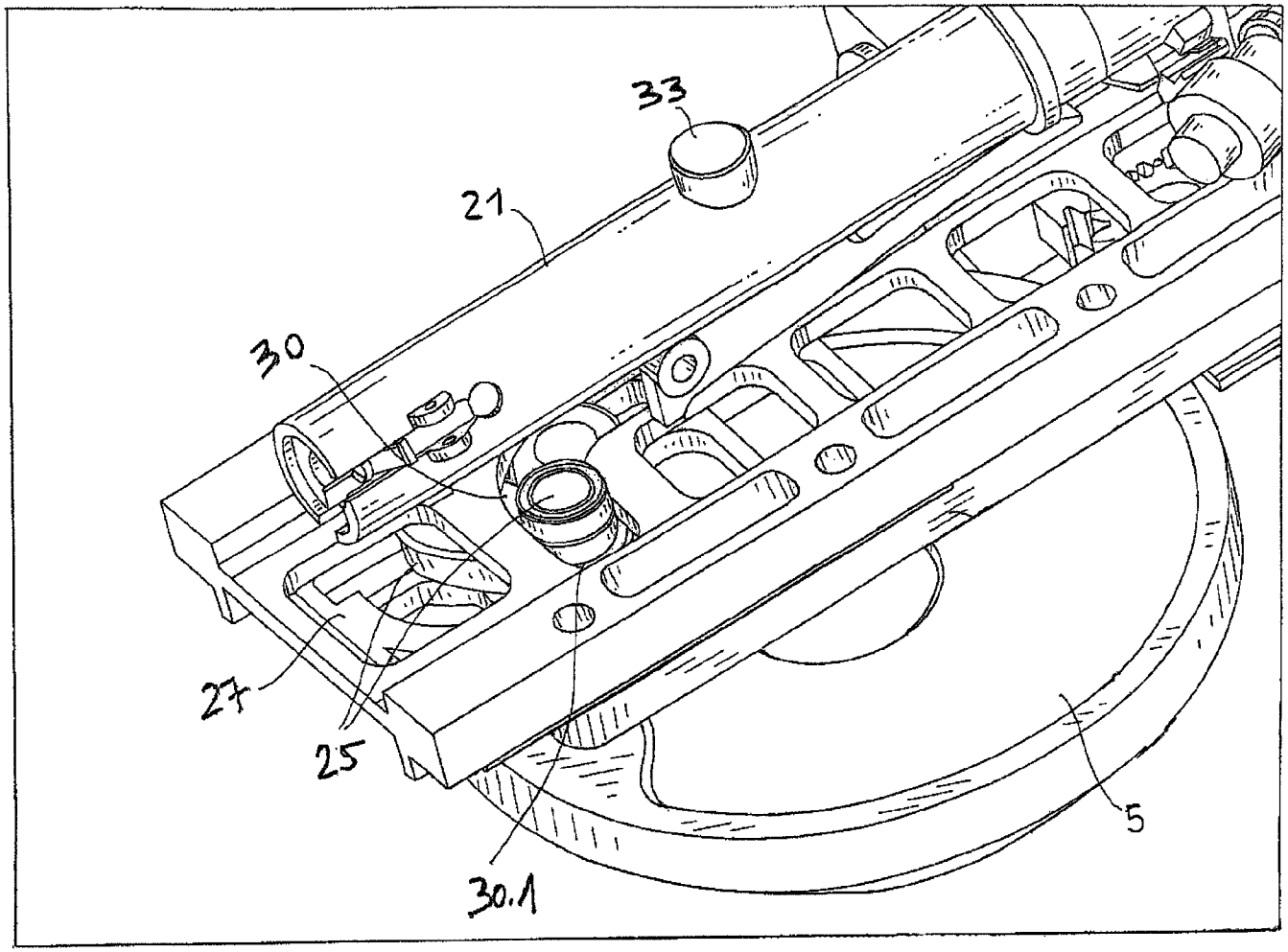
FIG. 4 is a view of the rear part of the breechblock drive from FIG. 1 without breechblock support.

FIG. 4 shows a top view of the disk 5, in which a long connecting rod 26 is integrated and to which the connecting rod is functionally connected. The long connecting rod 26 serves to convert the rotary motion of the disk 5 into a linear breechblock motion, and thus to actually move the breechblock/breechblock support 2, in conjunction with a short connecting rod 25. The rear end or pin of the long connecting rod 26 is fastened to/integrated into the cam disk 5. The front end (viewed in the direction of firing) of the connecting rod 26 engages via toothing 28 (FIG. 5) with a rack 29 that is fixed with respect to the weapon and with a slider 27 of the breechblock support 2. In this way, a better transmission ratio (for example, 1:2) can be established for the breechblock motion itself. This has the advantage that the diameter of the crankcase (disks 5+6) can be made smaller by one half than in the case of a 1:1 transmission. This entails lower weight.

Figure 5:
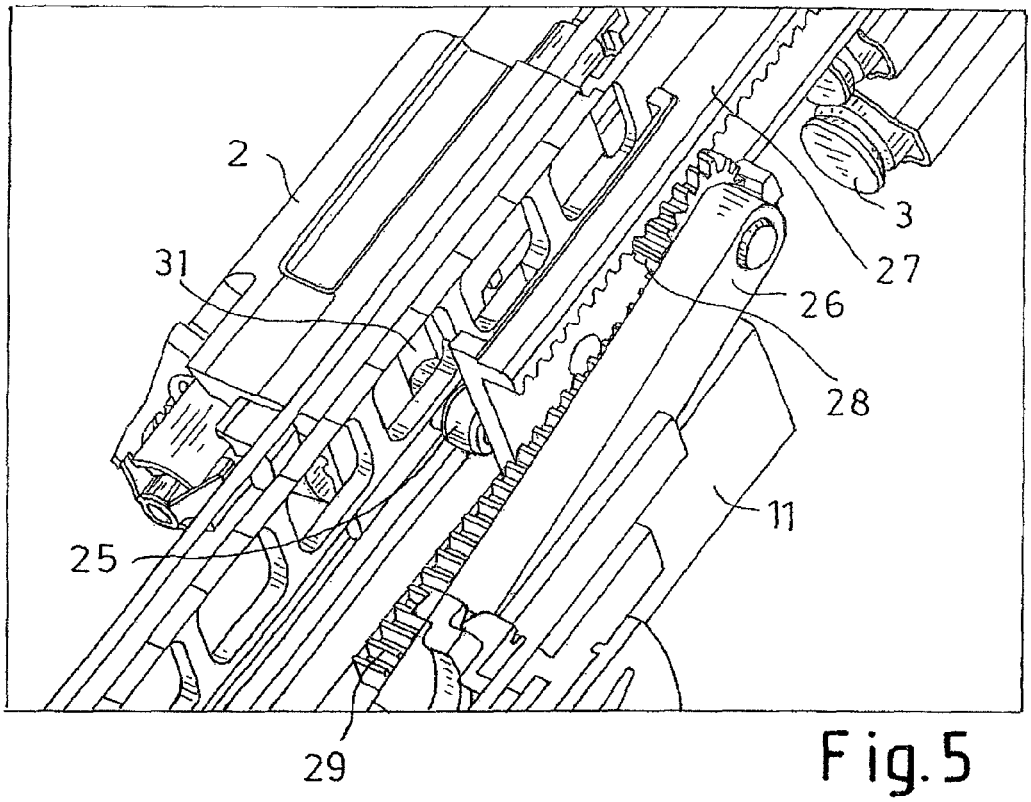
FIG. 5 is an enlarged view of the breechblock drive from FIG. 4 in a perspective view from below.

The short connecting rod 25 is held at one end in the slider 27 and guided therewith. At the other end, the short connecting rod 25 engages in a transverse slot 31 introduced above the connecting rod 25 and below the breechblock support 2 (FIG. 5). The short connecting rod 25 is guided in a slot 30 that is fixed with respect to the weapon, and carries the breechblock support 2 backward or forward on account of the engagement with the transverse slot 31 when the slider 27 is displaced by the long connecting rod 26. In the rear end position, the so-called dead center point of the feed, the connecting rod 25 is pivotable. This makes it possible for the breechblock support 2 to remain stationary (dwell time) in this rear position as the round of ammunition 3 is fed, while the system or the slider 27 continues to travel a short distance further. In this end position, the slot 30 has an endpoint 30.1 into which the connecting rod 25 is pushed. As a result of the pivotability, the slider 27 can continue to travel below the end point 30.1 in the slot 30 in spite of said end point. This design implements the—rear—dwell time of the breechblock during which ammunition loading takes place.

Figure 6:
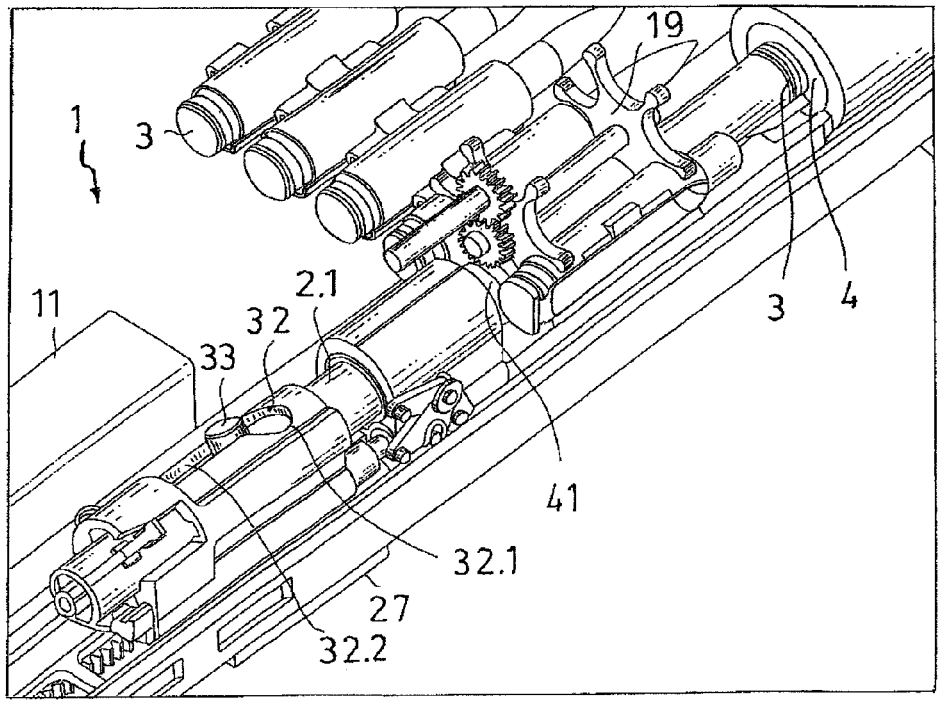
FIG. 6 is a view of the front part of the breechblock drive from FIG. 1 in the locked position.

The breechblock support 2 and breechblock 2.1 are structurally connected to one another by a carrier 33 that is functionally attached in a fixed manner to the breechblock 2.1. The locking of the breechblock 2.1 is achieved by means of an additional locking slot 32 (channel) integrated into the breechblock support 2, into which the carrier 33 can escape for locking. The breechblock 2.1 is guided by a part 40 that is stationary (on the weapon housing). Once the breechblock 2.1 reaches its front stop position, the slider 27 moves slightly further into its front end position. The breechblock support 2, in turn, is carried further via the top slot into a locking slot 32, which is preferably integrated above the breechblock support 2, in order to be able to lock the breechblock 2.1 in/onto the part 40 (locking lugs 41 in FIG. 2). For locking, the cam 33 then moves out of the slot 32.1 into a locking path 32.2 of the locking slot 32. In this way, a floating support (accommodating reverse motion) of the breechblock 2.1 is achieved in the firing position (FIG. 6).

The selective switching on and off of the ammunition feed and of the breechblock motion shall now be described in detail using these Figures.

During normal firing operation, the breechblock and ammunition drive 5, 6 are switched on continuously. Now if it is desired, the breechblock drive 5 and/or the ammunition drive 6 can be taken out of the drive system.

This can be accomplished by means of a lever, servomotor, etc., which is not shown in detail. The selector drum 12, and hence the cam segments 15, 16, are moved thereby in a manner that is not shown.

In the event that the ammunition drive 6 is switched off or removed from the system, the selector drum 12 brings the jaw clutch 18 out of the toothing or the gear 10. As a result, there is no longer force transmission from the gear 10 to the drive 6. The breechblock drive 5 remains switched on, however. By further rotation of the selector drum 12, the jaw clutch 18 can be brought back into force-locked connection with the toothing 10, so that the ammunition drive 6 is switched on again.

The same mode of operation applies to the switching on or off of the breechblock drive 5, for which purpose the jaw clutch 17 is brought into or out of the gear 9, while the ammunition transport continues to run. A further rotation of the selector drum 12 then causes the breechblock drive 5 to be switched on again.

It is a matter of course that a position is also integrated into the cams 15, 16 (FIG. 2, FIG. 3) in which both drives 5, 6 are taken out of the system.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A breechblock drive and an ammunition drive for a breechblock of a weapon, comprising:

a rotatable selector drum that is configured to cooperate with the drives;

cams arranged on a circumference of the selector drum; and cam surfaces adapted to be guided by the cams and that move clutches that cause the drives to be switched on or off when the selector drum is rotated, wherein one or more of the drives are selectively switched on or off.

2. The drive according to claim 1, wherein the drives are disks with external toothing, which are moved by at least one driven gear.

3. The drive according to claim 2, wherein the clutches are at least one upper and one lower square jaw clutch that each engage one of the at least one driven gear in an interlocking manner.

4. The drive according to claim 1, wherein an index drive with a cam follower wheel is integrated for the ammunition feed, and wherein the cam follower wheel is functionally connected to a feeding star.

5. The drive according to claim 4, wherein the index drive is a disk index drive with a complementary disk pair.

6. The drive according to claim 1, wherein a long connecting rod and a short connecting rod are integrated into the drive and are functionally connected thereto, wherein the long connecting rod serves to convert the rotary motion into a linear breechblock motion, and the short connecting rod serves to move the breechblock or a breechblock support.

7. The drive according to claim 6, wherein the long connecting rod is fastened at its back end or pin to or in the drive and at its front end engages via toothing with a rack that is fixed with respect to the weapon and with a slider of the breechblock support, wherein the short connecting rod is held in and guided by the slider and also engages in a transverse slot arranged above the connecting rod and below the breechblock support.

8. The drive according to claim 6, wherein the short connecting rod is guided in the slot that is fixed with respect to the weapon, which slot has a rear end point into which the connecting rod is pushed, to which end the short connecting rod is pivotable in the rear end position in the end point of the slot.

9. The drive according to claim 6, wherein the breechblock support and breechblock are structurally connected to one another by a carrier that is functionally attached in a fixed manner to the breechblock.

10. The drive according to claim 9, wherein the locking of the breechblock is achieved by an additional locking slot integrated into the breechblock support into which the carrier can shift for locking, wherein the locking slot has a locking path that accommodates the reverse motion of the breechblock.

11. A breechblock drive and an ammunition drive for a breechblock of a weapon comprising:

a first driven element operably connected to the breechblock of the weapon;

a second driven element operably connected to the ammunition drive of the weapon;

a first drive element engaging the first driven element;

a second drive element engaging the second driven element;

a drive;

a first clutch for selectively connecting the drive to the first drive element, the first clutch including a first cam follower;

a second clutch for selectively connecting the drive to the second drive element, the second clutch including a second cam follower;

a rotatable selector drum having a first cam for moving the first cam follower from a first position to a second position to engage the first clutch and connect the drive to the first drive element and a second cam for moving the second cam follower from a first position to a second position to operate the second clutch and to connect the drive to the second drive element.

12. The drive according to claim 11, wherein the rotatable selector drum is configured to move the first and second cams independently.

13. The drive according to claim 11, wherein the first driven element is a first driven gear and wherein the second driven element is a second driven gear.

14. The drive according to claim 13, wherein the first drive element is a first drive gear and wherein the second drive element is a second drive gear.

15. The drive according to claim 11, wherein the first clutch is a first jaw clutch and wherein the second clutch is a second jaw clutch.

16. The drive according to claim 11, wherein the first drive element has a first axis of rotation and the second drive element has a second axis of rotation coaxial with the first axis of rotation, the drive including a guide element having a longitudinal axis parallel to the first axis of rotation, the first clutch including a first guided member connected to the first cam follower and slidably mounted on the guide element and the second clutch including a second guided member connected to the second cam follower and slidably mounted on the guide element.

* * * * *